US006810633B2

(12) United States Patent
Harris, Sr.

(10) Patent No.: US 6,810,633 B2
(45) Date of Patent: Nov. 2, 2004

(54) DECK BOARD FASTENER

(76) Inventor: G. Steven Harris, Sr., 4915 W. 120th Pl., Overland Park, KS (US) 66209

( * ) Notice: Subject to any disclaimer, the term of this patent is extended or adjusted under 35 U.S.C. 154(b) by 46 days.

(21) Appl. No.: 10/210,971

(22) Filed: Aug. 2, 2002

(65) Prior Publication Data

US 2004/0020152 A1 Feb. 5, 2004

(51) Int. Cl.[7] ..... B25G 3/00

(52) U.S. Cl. ..... 52/489.2; 52/586.2; 52/591.5; 52/650.3

(58) Field of Search ..... 52/489.1, 489.2, 52/582.2, 586.2, 591.3, 591.5, 592.2, 730.6, 650.3; 403/231, 232.1, 408.1, 292, 294, 286

(56) References Cited

U.S. PATENT DOCUMENTS

| | | | | | |
|---|---|---|---|---|---|
| 695,722 | A | * | 3/1902 | Heilmann | 52/509 |
| 1,018,987 | A | * | 2/1912 | Philpot et al. | 52/177 |
| 2,081,368 | A | * | 5/1937 | Pretot | 52/489.1 |
| 3,946,529 | A | * | 3/1976 | Chevaux | 150/105 |
| 4,891,920 | A | * | 1/1990 | Pingston | 52/145 |
| 5,359,954 | A | | 11/1994 | Kordelin | |
| 5,529,428 | A | | 6/1996 | Bischof | |
| 5,623,803 | A | | 4/1997 | Willis | |
| 5,660,016 | A | | 8/1997 | Erwin et al. | |
| 5,730,544 | A | | 3/1998 | Dils et al. | |
| 6,289,646 | B1 | * | 9/2001 | Watanabe | 52/506.01 |
| 6,314,699 | B1 | | 11/2001 | West | |
| 6,402,415 | B1 | | 6/2002 | Eberle, III | |
| 6,594,961 | B2 | * | 7/2003 | Leines | 52/177 |
| 2001/0027829 | A1 | | 10/2001 | Crout | |
| 2002/0059766 | A1 | | 5/2002 | Gregori | |

* cited by examiner

*Primary Examiner*—Carl D. Friedman
*Assistant Examiner*—Basil Katcheves
(74) *Attorney, Agent, or Firm*—Chase Law Firm, L.C.

(57) ABSTRACT

A fastening device for securing adjacent, parallel boards to a transverse structure, including a top plate having flanges to fit into slots cut into the sides of boards, a center hole in the top plate to accommodate a screw or nail, and top and bottom tabs to provide uniform spacing and to support the fastener during attachment to the support structure.

12 Claims, 4 Drawing Sheets

DECK BOARD FASTENER

FIELD OF THE INVENTION

The present invention relates to devices for fastening boards to supporting structures and more particularly to a fastener for securing adjoining boards to a common substructural element such as a joist.

BACKGROUND OF THE INVENTION

Conventional decks typically include horizontal floors raised above the ground and supported by an underlying structure. Decks are often attached to adjacent residential or commercial buildings. Deck boards are placed side by side during construction of a deck, and are typically arranged to cross the structures, such as joints at an angle perpendicular to the longitudinal axis of the joist. Other structures utilizing similar flooring techniques include boat docks, ramps, stairs, landings, bridges, platforms and for structures for surrounding or enclosing swimming pools and hot tubs.

Typically, decks are constructed to withstand exposure to the elements and are often constructed from pressure treated wood for, more recently, plastic. Whether the deck boards, which form the flooring of the deck are comprised of wood or plastic or other material, the substructure is typically formed of commonly available pressure treated lumber. The substructure is formed with joist and headers attached to posts. The deck boards are typically transversely fixed across the joist so the substructure, in a generally parallel relationship, by way of nails or screws, driven through the upper surface of the deck board into the joist below.

This manner of attaching deck boards to the substructure presents several disadvantages. If nails or screws are used, they typically cause discoloration of the surrounding wood surface over time. In addition, in driving the nail through the wood or plastic deck board, the surface of the board is often marred during hammering, causing unsightly dents and scratches to the top surface of the board. Over time, nails have a tendency to work themselves loose from the board, projecting upward from the board's surface. Not only is this aesthetically unpleasing, it causes the deck board to loosen against the joist and also constitutes a safety hazard, particularly to individuals walking over the deck surface barefoot. In addition, both nails and screws are prone to rusting over time, causing failure to the attachment.

Removal of one or more deck boards entails prying the nails loose which is both time consuming and causes damage to the surface of the board.

BRIEF SUMMARY OF THE INVENTION

It is therefore an object of the present invention to provide a deck fastener that provides easy installation and removal of deck boards, and avoids the difficulties presented by nails or screws driven through the top of deck boards.

The deck board fastener of the present invention includes a device having two flat, relatively narrow flanges that project outward and fit into slots formed or cut in the side edges of each deck board at the location on the edge of the deck board where it crosses a joist. Each flange of the device, therefore, fits into an adjacent deck board. The boards are then held in place by driving a screw or nail into the center hole of the device into a joist below. In order to facilitate use of the fastener during deck construction and to provide a means of assuring even gaps between boards throughout the deck structure, the device also includes vertically oriented bottom and top tabs that project from the bottom and top of the flat horizontal surface of the device. These tabs also serve to stabilize the fastener when it is inserted into the slot of the first deck board, prior to engaging the adjacent board and subsequent fastening with a screw or nail. The device serves not only as an attachment means, but as a gauge to assure that gaps are evenly spaced throughout the deck to yield a more pleasing appearance.

BRIEF DESCRIPTION OF THE DRAWINGS

The above features and advantages of the invention will become apparent from a consideration of the subsequent detailed description presented in connection with the accompanying drawings, in which.

DETAILED DESCRIPTION

Figure 1:
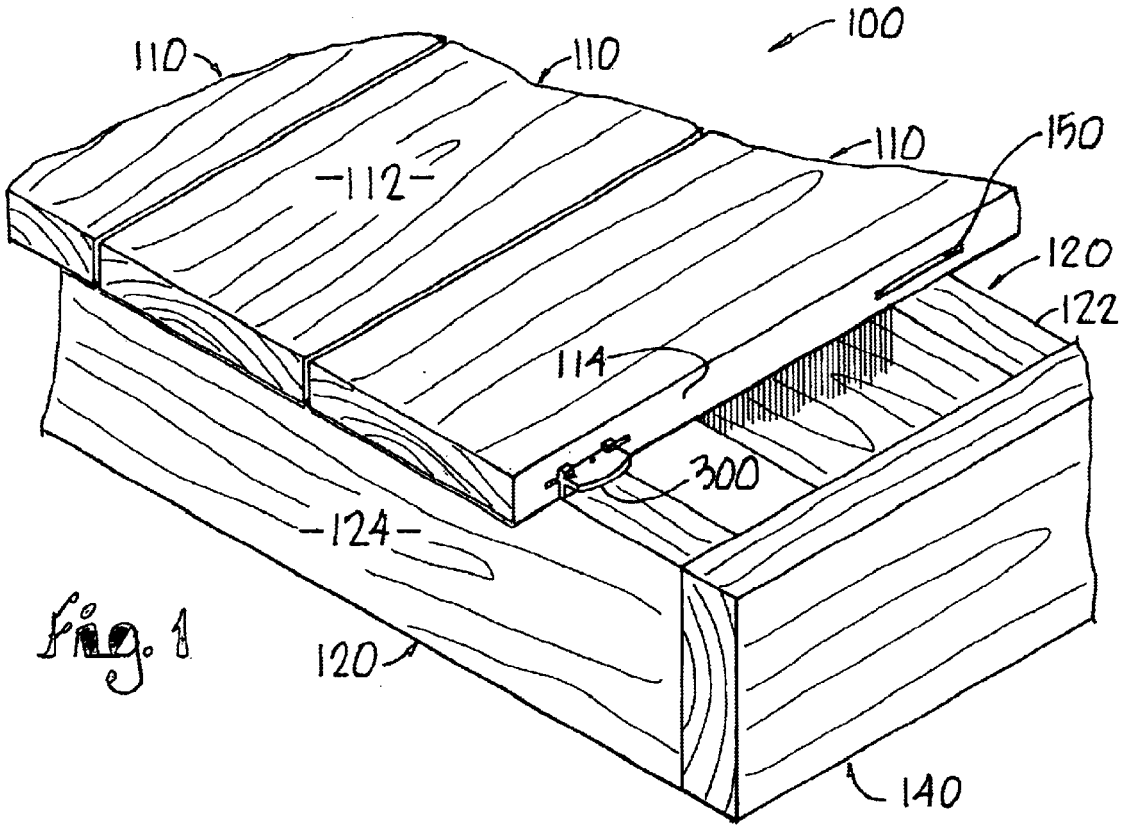
FIG. 1 is a perspective view of a deck structure showing the substructure of a deck, including a joist and a header, as well as deck boards prepared for attachment including slots therein and a positioned deck board fastener in accordance with the present invention.

In the construction of a deck 100 or similar structure as shown in FIG. 1, the supporting substructure is typically built from weather resistant materials, often pressure treated lumber, including vertical posts secured to the ground, spaced parallel joists 120 extending between the posts, headers 140 spanning the posts and connecting the ends of the joists 120 to one another, and deck boards 110 fixed transversely to the top of the joists 120 to form a platform. While the substructure is more commonly comprised of wood, the deck boards 110 may be formed from wood, plastic or other resilient material.

FIG. 1 illustrates deck boards 110 placed transversely across parallel joists 120 during fastening. In accordance with the present invention, slots 150 have been formed or cut into the longitudinal sides 114 of the deck boards 110 at the point where a deck board 110 crosses an underlying joist 120. The slots 150 are approximately two and one-half inches wide, one-half inch deep and one-eighth inch tall. Slots 150 may be cut into the sides 114 of a deck board 110 using known woodworking tools such as a biscuit joiner. Optimally, slots 150 are cut at least one-eighth inch from the top surface 112 of the deck board 110 and at least three-eighths inches from the bottom surface 116 of the deck board 110 (see FIG. 8). As the deck boards 110 are positioned and the slots 150 are cut, deck board fasteners 300 are inserted into the slots 150.

Figure 2:
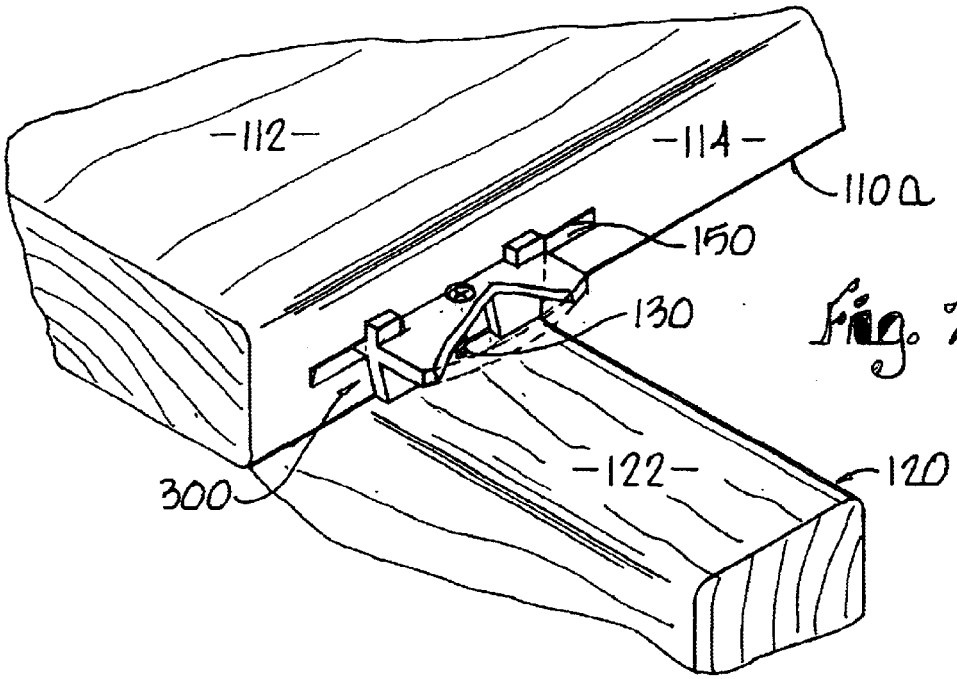
FIG. 2 is an enlarged perspective view of a deck board fastener of the present invention positioned for attachment to a joist.

FIG. 2 is an enlarged view of a deck board 110 fastened to a joist 120 by a deck board fastener 300 of the present invention. The fastener 300 has been inserted into a slot 150 within the deck board 119 and secured to a joist 120 by an anchoring device such as a screw 130, as shown. Alternatively, a nail or other suitable device could be used to secure the fastener 300.

Figure 3:
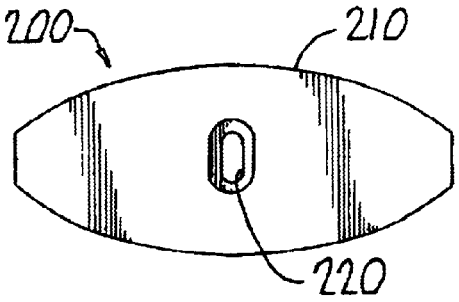
FIG. 3 is a top view of a prior art fastener illustrating a flat top element.
Figure 4:
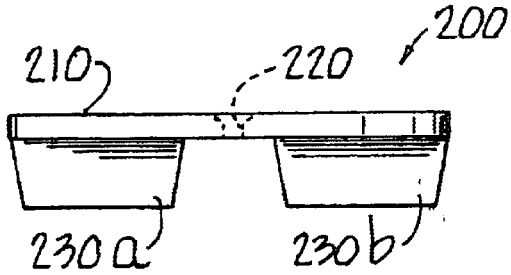
FIG. 4 is a side elevational view of the prior art fastener of FIG. 3.
Figure 5:
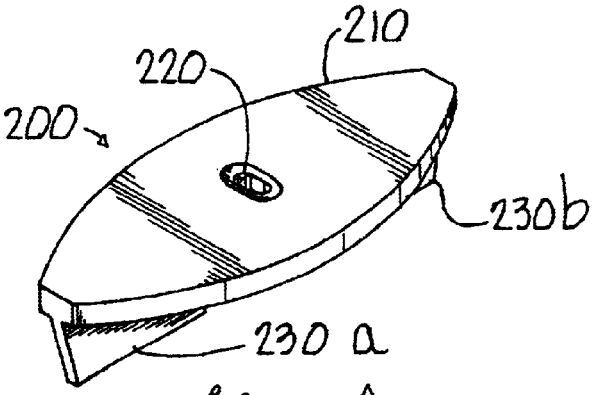
fig. 5 PRIOR ART
FIG. 5 is a perspective view of the prior art fastener of FIGS. 3 and 4.

FIGS. 3–5 illustrate a prior art device 200 used for fastening deck boards as disclosed in U.S. Pat. No. 6,402,415 to Eberle, III. The device 200 has a flat, biscuit-shaped top element 210 approximately two and one-half inches long, a center hole 220, and two lower vertical support members 230*a* and 230*b* attached to the underside of the top element 210. In use, the top element 210 fills the slot 150 created by a biscuit joiner blade and spans a typical one and one-half inch wide joist 120, with approximately one-half inch of the top element 210 extending past the edge of the joist on either side. While presumably operative, the absence of top tab structures 350 may render the prior art fastener unstable when placed into the slot 150 of a first deck board 110 prior to engagement with a second deck board. In addition, since the biscuit-shaped top element 210 of the prior device 200 is approximately the same length as the slot 150, it allows for little or no adjustment of the device 200 within the slot 150 as may be necessary to align with an underlying joist 120.

As shown in detail in FIGS. 6 through 11, a deck board fastener 300 of the present invention includes a horizontal top plate 310 with first 312*a* and second 312*b* flanges that extend into slots 150 cut into adjoining deck boards 110. Projecting upward from the top surface of the top plate 310 are first 350*a* and second 350*b* top tabs. The top plate 310 is approximately one-eighth inch in thickness to fit the dimensions of a slot cut by a typical biscuit joiner blade. The top tabs 350 are preferably one-eighth inch high and between one-eighth and one-quarter inches in lateral width. First and second bottom tabs 330*a* and 330*b* project downward from the lower surface of the top plate 310 and are vertically coplanar with the top tabs 350. The bottom tabs 330 are of substantially the same lateral width as the top tabs 350, and in conjunction with the top tabs 350, serve as a mechanism to assure uniform spacing between adjoining deck boards 110. It may be appreciated that if a wider spacing is desired between deck boards 110, a deck board fastener 300 may be used with top 350 and bottom 330 tabs having a corresponding greater thickness than the preferred dimensions.

A center hole or opening 320 is located in the top plate 310 between the top tabs 350 and the bottom tabs 330. The center hole 320 allows an attachment or anchoring means 130 such as a screw or nail to pass through the top plate 310 and into an underlying joist 120.

In use, a first flange 312*a* of a deck board fastener 300 is inserted into the slot 150*a* of a deck board 110*a*. See FIGS. 2 and 8. A second deck board 110*b* is then brought alongside and the second flange 312*b* of the deck board fastener 300 is moved within slot 150*b* of the second deck board 100*b* as the second deck board 110 is moved against the top 350 and bottom tabs 330. A nail or screw 130 is then driven through the center hole 320 of the top plate 310 thereby fixing the deck board fastener 300 to the underlying joist 120. As the fastener 300 is secured to the joist 120, the flanges 312 of the deck board fastener 300 likewise fasten the deck boards 110 to the joist 120.

In the preferred embodiment of the present invention, the top and bottom tabs 330 and 350 are one-quarter inch wide to approximate the width of the head of a narrow-head deck screw 130. This greater width provides an advantage over the prior art device of FIGS. 3–5 in that a screw 130 may more readily driven into the center hole 320 after the fastener 300 is positioned between adjoining deck boards 110. To avoid marring the sides 114 and top edge of fastened deck boards 110, the prior art device 200 must be installed while inserted into one deck board 110 only, as the width of even a narrow-head deck screw exceeds one-eighth inch.

The preferred embodiment presents further advantages in that the top plate 310 is formed of a rigid material. In use, the prior art device of FIGS. 3–5 tends to flex or bend downward under the pressure exerted by a tightened or driven screw 130. As it occurs prior to insertion of the top element 210 into the second board, this distortion can cause the top element 210 to deform from the horizontal plane impeding insertion into the second board slot. In addition, the deformation caused by pressure from the driven screw 130 may cause the top element 210 to come out of the first board slot. In addition, the prior art device 200 is not rigid enough to withstand pressure from a driven screw sufficient to allow the head of the screw to be driven into, and substantially flush with, the surface of the top element 210.

Because the preferred embodiment of the present invention has greater rigidity than the prior art device 200, the above disadvantages are avoided. In use, a fastener according to the preferred embodiment withstands pressure from the driven screw 130 sufficient to allow the screw head to be driven into the center hole 320 so that the screw head is flush with, or downwardly recessed from, the top surface of the fastener 300.

As an additional aid to rigidity, the preferred embodiment may further incorporate a bottom ridge 360 spanning the space between the two bottom tabs 330. See FIGS. 7, 9 and 10. This ridge 360 increases overall structural rigidity as it lies directly underneath and surrounds the center hole 320 thereby transferring stress applied by a driven screw 130 to the rigid bottom tabs 330.

Figure 6:
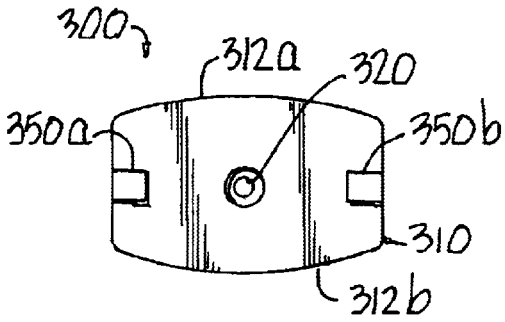
FIG. 6 is a top view of a deck board fastener in accordance with the principles of the present invention.

FIG. 6 is a top plan view of a deck board fastener 300 including a pair of top tabs 350 and a center hole 320. FIG. 6 also shows the desired curvature of the flange surfaces 312 of the fastener which are formed to match the curvature of the slot 150 formed by a typical biscuit joiner blade. The deck board fastener 300 is optimally one and one-half inches in length to match the width of a common joist 120 used in forming decking structures 100.

Figure 7:
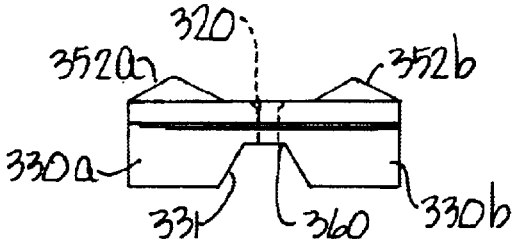
FIG. 7 is a side elevational view of the deck board fastener of FIG. 6 with alternative triangular profile top tabs.

FIG. 7 is a side elevational view of a deck board fastener 300, showing top tabs 350 having a triangular profile to minimize the observability of top tabs 350 from above when installed. Bottom tabs 330 extending from the bottom surface of the top plate are also shown in FIG. 7. Preferably, the inner surfaces 331 of the bottom tabs 330 angle away from the center hole 320 in order to allow clearance for a nail or screw 130 driven at an angle.

Figure 8:
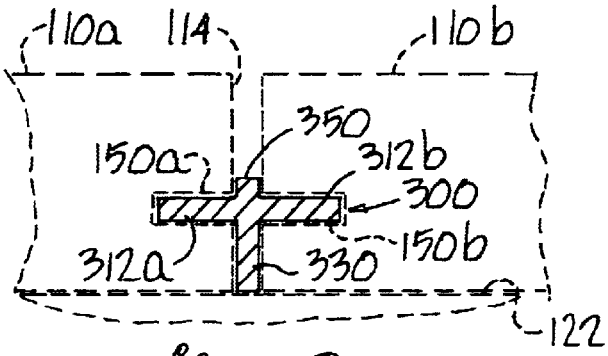
FIG. 8 is cross-sectional view of a deck board fastener positioned between two adjacent deck boards resting on a joist, said deck boards and joist drawn in phantom lines.

FIG. 8 is a cross-sectional view of a deck board fastener 300 illustrating first 312*a* and second 312*b* horizontal flanges, a top tab 350 and a bottom tab 330. It should be appreciated that the dimensions of the flanges 312 and tabs 330 and 350 may be altered to fit the requirements of particular construction parameters, such as slot 150 depth and width, board 110 height, and desired board spacing. Preferably, the flanges 312 are one-eighth inches thick, the bottom tab 330 is three-eighths inch high, the top tab 350 is one-eighth inch high, and both bottom and top tabs are from one-eighth to one-quarter inch thick. These dimensions provide a deck board fastener 300 with an overall height of approximately five-eighths inches, which will accommodate three-quarter inch thick deck material as well as provide a suitable fastener for typical one and one-half inch thick deck boards 110.

Figure 9:
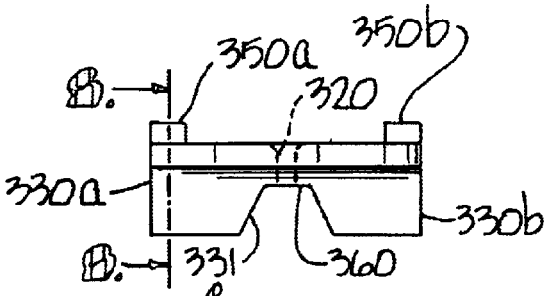
FIG. 9 is a side elevational view of the deck board fastener of FIG. 6 showing the preferred rectangular profile top tab configuration.
Figure 10:
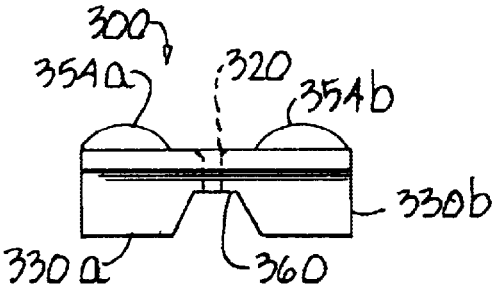
FIG. 10 is a side elevational view of a deck board fastener showing an alternative rounded or semi-circular top tab configuration.
Figure 11:
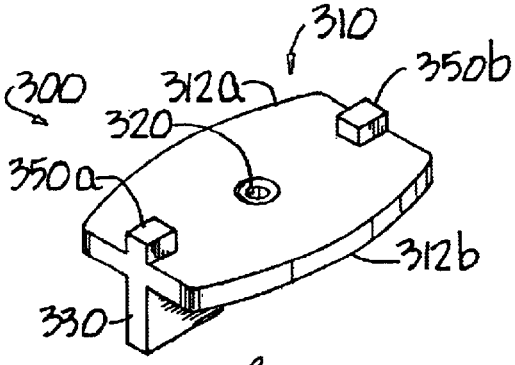
FIG. 11 is a perspective view of the deck board fastener embodiment shown in FIGS. 6 and 9.

FIG. 9 is a side elavational view of a deck board fastener 300 having substantially rectangular top tabs 352. FIG. 10 is a side elevational view of a deck board fastener having rounded or semi-circular top tabs 354. This design provides similar advantages to the triangular shaped top tabs 350 of FIG. 7. Both the rounded 354 and triangular 350 shaped top tabs are more unobtrusive when viewed from above particularly if the decking 110 selected is less than one inch thick. FIG. 11 is a perspective view of the deck board fastener 300 illustrated in FIGS. 6 through 9.

Figure 12:
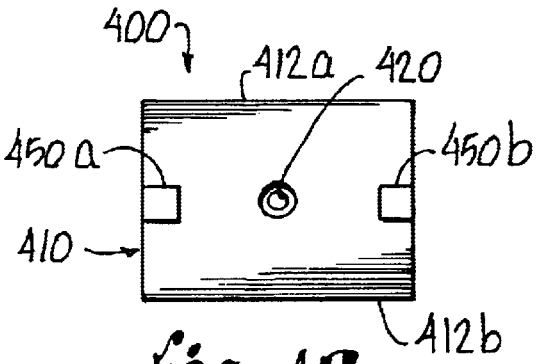
FIG. 12 is a top plan view of a deck board fastener showing an alternative embodiment having rectangular flanges.
Figure 13:
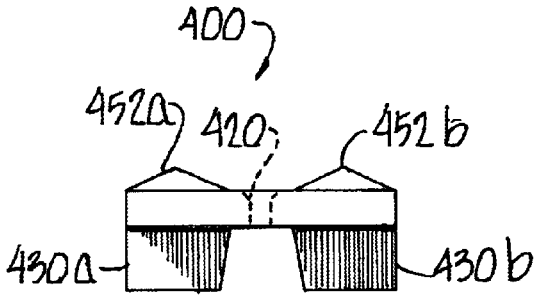
FIG. 13 is a side elevational view of the deck board fastener of FIG. 12 showing alternative triangular profile top tabs.
Figure 14:
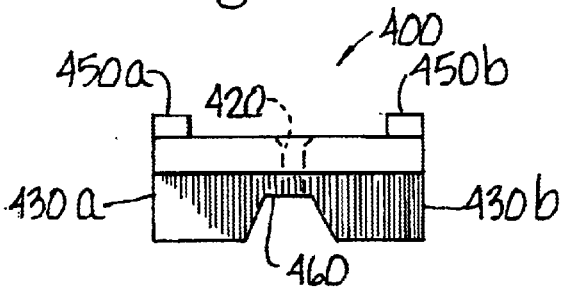
FIG. 14 is a side elevational view of the deck board fastener of FIG. 12 showing the preferred rectangular top tab configuration.
Figure 15:
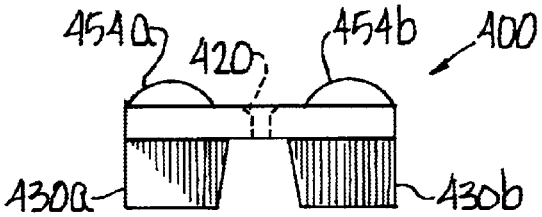
FIG. 15 is a side elevational view of the deck board fastener of FIG. 12 showing an alternative rounded or semi-circular top tab configuration.
Figure 16:
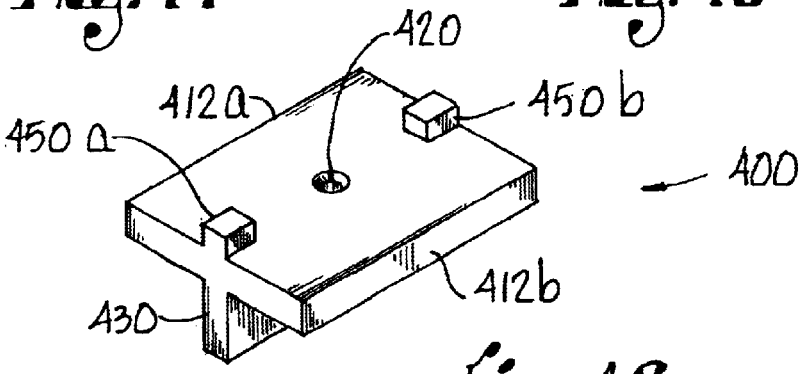
FIG. 16 is a perspective view of the deck board fastener embodiment shown in FIGS. 12 and 14.

FIGS. 12 through 16 illustrate alternative embodiments of the present invention that are particularly appropriate for use with deck boards in which a continuous slot or dado has been cut with a table saw or router rather than individual slots as with a biscuit joiner. A continuous slot does not present a curved surface requiring curved flanges. The devices 400 illustrated in FIGS. 12 through 16, therefore, have flanges 412 presenting a rectangular profile to match the profile of the continuous slot and improve stability of the device 400 within the slot. The flanges 412 as shown are one-quarter inch in vertical thickness, rather than one-eighth inch as the device 300 shown in FIGS. 6 through 11, in order to match the thickness of a typical slot cut by available dado or router blades. The device 400 of FIGS. 12 and 14 is shown perspective in FIG. 16 and has relatively square top tabs 450. FIGS. 13 and 15 show devices 400 having triangular 452 and rounded 454 tabs respectively.

It should be appreciated that forms of this invention, including devices illustrated in FIGS. 1–2 and 6–16, may be used to attach boards to substructures to form structures other than decks including vertical structures such as fences or walls.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. A fastening device for securing boards to a support structure, said device comprising:

a first flange joined with a coplanar second flange and adapted to be disposed in a generally horizontal position in use, said flanges extending laterally outwardly in opposite directions from a longitudinal axis of said device at the juncture of said flanges, said flanges having an opening therein extending downwardly therethrough at a central portion of said axis for receiving an anchoring device, first and second top tabs extending upwardly from said axis and disposed on opposite sides of said opening, first and second bottom tabs extending downwardly from said axis and disposed on opposite sides of said opening, and a ridge extending downwardly from said longitudinal axis and between said bottom tabs.

2. The fastening device of claim 1 wherein said flanges include convex, curved outer edges.

3. The fastening device of claim 1 wherein said flanges include straight edges, parallel to said longitudinal axis.

4. The fastening device of claim 1 wherein said flanges have sufficient rigidity to resist deformation during fastening.

5. The fastening device of claim 1 wherein said top tabs have a substantially rectangular elevational profile.

6. The fastening device of claim 1 wherein said top tabs have a substantially triangular elevational profile.

7. The fastening device of claim 1 wherein said top tabs have a substantially semi-circular elevational profile.

8. The fastening device of claim 1 wherein said opening extends downwardly through said ridge.

9. The fastening device of claim 1 wherein said bottom tabs include downwardly extending walls, a portion of said walls proximate to said opening being relieved as said walls extend downwardly from said longitudinal axis, thereby reducing potential interference between said tabs with the body of an anchoring device received by said opening upon attachment of said fastening device to a substructural element.

10. A fastening device for securing boards to a support structure, said device comprising:

a first flange joined with a coplanar second flange and adapted to be disposed in a generally horizontal position in use, said flanges extending laterally outwardly in opposite directions from a longitudinal axis of said device at the juncture of said flanges, said flanges having outer edges shaped to substantially fit the curvature of a receiving slot in a board, and having an opening therein extending downwardly therethrough at a central portion of said axis for receiving an anchoring device, first and second top tabs extending upwardly from said longitudinal axis and disposed on opposite sides of said opening, first and second bottom tabs extending downwardly from said longitudinal axis and disposed on opposite sides of said opening, and a ridge on said flanges extending downwardly from said longitudinal axis and between said bottom tabs.

11. The fastening device of claim 10 wherein said bottom tabs include downwardly extending walls, a portion of said walls proximate to said opening extending outwardly and away from said opening as said walls extend downwardly from said flanges, thereby reducing potential interference between said tabs with the body of an anchoring device received by said opening upon attachment of said fastening device to a substructural element.

12. A deck board fastening device for securing deck boards to a support structure, said device comprising:

a first flange joined with a coplanar second flange and adapted to be disposed in a generally horizontal position in use, said flanges extending laterally outwardly in opposite directions from a longitudinal axis of said device at the juncture of said flanges, said flanges having outer edges shaped to substantially fit the curvature of a receiving slot in a board, and having an opening therein extending downwardly therethrough at a central portion of said axis for receiving an anchoring device, first and second top tabs extending upwardly from said longitudinal axis and disposed on opposite sides of said opening;

first and second bottom tabs extending downwardly from said longitudinal axis and disposed on opposite sides of said opening, said bottom tabs including downwardly extending walls, a portion of said walls proximate to said opening extending outwardly and away from said opening as said walls extend downwardly from said flanges, thereby reducing potential interference between said tabs with the body of an anchoring device engaged with said opening upon attachment of said deck board fastener to a deck substructural element; and a ridge on said flanges extending downwardly from said longitudinal axis and between said bottom tabs.

* * * * *